US007648172B2

(12) United States Patent
Steele

(10) Patent No.: US 7,648,172 B2
(45) Date of Patent: Jan. 19, 2010

(54) KIT FOR MANUFACTURING A STITCH-BOUND PRINTED BOOK

(75) Inventor: Kevin Paul Steele, Gland (CH)

(73) Assignee: C.P.E. Communication Promotion Edition S.A., Bulle (CH)

( * ) Notice: Subject to any disclaimer, the term of this patent is extended or adjusted under 35 U.S.C. 154(b) by 761 days.

(21) Appl. No.: 11/067,202

(22) Filed: Feb. 25, 2005

(65) Prior Publication Data

US 2005/0141987 A1 Jun. 30, 2005

(51) Int. Cl.
*B42D 1/00* (2006.01)

(52) U.S. Cl. ..... 281/21.1; 412/1; 412/6; 412/7; 281/29

(58) Field of Classification Search ..... 281/21.1, 281/15.1, 27, 29, 36, 51; 412/4, 6, 7, 8, 901, 412/35, 33, 36; 206/575, 223
See application file for complete search history.

(56) References Cited

U.S. PATENT DOCUMENTS

| | | | | |
|---|---|---|---|---|
| 3,825,964 | A * | 7/1974 | Groswith et al. | 412/5 |
| 4,091,487 | A * | 5/1978 | Axelrod | 412/5 |
| 4,184,218 | A * | 1/1980 | Hawkes | 412/8 |
| 5,605,425 | A * | 2/1997 | Schaefer | 412/4 |
| 6,042,318 | A | 3/2000 | Ferrante | |
| 6,126,202 | A | 10/2000 | Scocca | |
| 6,155,763 | A * | 12/2000 | Parker et al. | 412/6 |
| 7,351,024 | B2 * | 4/2008 | Parker | 412/8 |
| 2004/0066029 | A1 * | 4/2004 | Parker | 281/4 |
| 2004/0120794 | A1 * | 6/2004 | Parker | 412/8 |

FOREIGN PATENT DOCUMENTS

| | | | |
|---|---|---|---|
| EP | 0 489 535 | | 6/1992 |
| EP | 747239 | A1 * | 12/1996 |
| GB | 2 050 445 | | 1/1981 |
| GB | 2 221 190 | | 1/1990 |
| JP | 01075291 | A * | 3/1989 |
| JP | 2002166679 | | 6/2002 |
| JP | 2002178664 | | 6/2002 |
| WO | WO 92/02888 | | 2/1992 |

* cited by examiner

*Primary Examiner*—Dana Ross
*Assistant Examiner*—Jamila Williams
(74) *Attorney, Agent, or Firm*—Sturm & Fix LLP

(57) ABSTRACT

A kit for manufacturing a stitch-bound printed book comprises a book cover (10), a collection of pre-perforated sheets (15) that can be printed to make up a printed bookblock (18), and endpapers (20*a*,20*b*) for assembling the printed bookblock in the cover. The pre-perforated loose sheets (15) have along one edge that corresponds to the book's spine a series of binding perforations (16). The pre-perforated loose sheets (15) are printable on one or both sides in an A4 printer to constitute printed pages of the book. A bookblock (18) is formed by reconstituting the printed pre-perforated pages as a collection with their perforations (16) aligned and by sewing through the perforations (16). This involves stitch-binding of individual sheets (15) instead of the usual stitch-binding of folded sheets, which makes it feasible to print the prepared collection of pre-perforated sheets using desktop publishing equipment. The kit lends itself to using adhesive contact paper for the endpapers (20*a*,20*b*) in place of the application of glue, making binding practical and convenient.

14 Claims, 4 Drawing Sheets

KIT FOR MANUFACTURING A STITCH-BOUND PRINTED BOOK

The invention relates to manufacturing books particularly in the context of desktop publishing.

BACKGROUND OF THE INVENTION

Today, desktop publishing in both the software and printing sectors has advanced to quality levels comparable to professional offset printing.

Despite the fact that printing equipment, special quality paper and publishing software are readily available on the market, there remains one outstanding component that would complete desktop publishing operations: the binding of a desktop-printed book in a professional and traditional style.

A traditional book has a collection of printed pages or bookblock mounted in a cover by endpapers which are pasted to the inside front and back covers of the book. The printed pages making up the bookblock are usually a series of folded over sheets or "sections" that are sewn together and assembled into the bookblock. Commercial binding produces these traditional books of good quality at a reasonable price for large series, but for individual books or books produced in small series the cost of binding is prohibitive.

Thermal binding using hot melt adhesives has been widely used particularly for soft cover books. However, thermal binding does not produce a book having the same qualities as a traditionally bound book. U.S. Pat. No. 6,042,318 for example discloses an apparatus and method for hot melt binding.

WO 92/02888 describes a computer based book manufacturing, distributing and retailing system wherein the text and images of a large number of books are stored in a computer, and individual books can be printed to command and bound in a thermal binder, enabling the delivery of a selected book to a purchaser in a short time.

U.S. Pat. No. 6,126,202 describes a book publishing kit for children, the kit including a number of sheets and templates permitting children to provide text and drawings to be forwarded for assembling and publishing as a book.

A child's bookbinding kit has been marketed under the name "Story Plus". This is intended primarily for children to produce a book including the child's paintings on folded-over sheets. The sheets have large openings for the child to sew the folded sheets together and assemble them into a book using glue.

GB-A 2 221 196 describes making a book by folding printed sheets and wire-stitching them along the fold line, in replacement of prior techniques where the folded sheets were sewn along their fold line.

JP-A-2002 178664 describes producing a book using a personal computer using a standard story that can be varied by the author, printing on a standard printer and then stapling together the printed sheets and sticking the outside sheet of the stapled printed sheets directly to a book cover.

Various pieces of office equipment have been developed for clasping or attaching together sheets using plastic or metal securing elements, or by thermal binding. However the resulting assembled sheets are not comparable to the traditional book structure having a stitch-bound bookblock mounted in a cover by endpapers.

There remains a need for a simple and easy-to-use book binding kit, which enables any individual or business to manufacture a bound book of traditional structure and of the quality found on the market, using existing desktop publishing equipment.

SUMMARY OF THE INVENTION

The invention offers a solution to the problem of short-run printing and binding costs. It makes it possible to print and stitch-bind to professional standards one-book units at a price that was previously reserved for a large series of printed copies (two thousand or more).

The invention provides a kit for manufacturing a stitch-bound printed book, whose principal components are a book cover, a collection of pre-perforated sheets that can be printed usually using a desktop printer of A4 format to make up a printed bookblock, and endpapers for assembling the printed bookblock in the cover.

The first principal component of the kit is a book cover composed of a front and a back attached by a spine for accepting a bookblock formed from a collection of bound pages of corresponding size.

The kit also includes a corresponding pre-perforated collection of loose single unfolded sheets for making up a bookblock that fits the book cover. The loose sheets have printable areas. They are usually blank sheets initially. Their size corresponds to a given printing format, for example A5, 21×21 cm, or A4, acceptable by available personal printers such as standard A4 desktop printers. The collection of loose sheets has, along one unfolded edge that corresponds to the book's spine, a series of binding perforations for accepting a binding thread. The loose unfolded sheets are printable on one or both sides with text, images or both to constitute printed pages of the book, using a normal desktop printer. The printed pages can then be bound to form the bookblock by reconstituting them as a collection with their binding perforations aligned and by sewing thread through the binding perforations.

The remaining main components of the kit are: a pair of front and back endpapers i.e. including folded-over sheets forming board papers that are attachable to the inside front and back faces of the book cover for securing the bookblock—which is formed by sewing together the collection of loose pre-perforated printed sheets—to form the stitch-bound printed book; and peel-off adhesive layers for securing the bookblock to the front and back endpapers and for securing the front and back endpapers to the cover.

Particularly when it is packaged for individual sales, the kit can also include a needle and thread, clamps for facilitating assembly, adhesive strips, a jacket, printed instructions and software. The parts of the kit can be sold together or individually.

Manufacturing a book from a kit according to the invention involves stitch-binding of individual unfolded sheets instead of the usual stitch-binding of folded sheets. This makes it technicaly feasible to print the prepared collection of perforated sheets in an A4 printer. The kit also lends itself to using adhesive contact paper for the endpapers in place of the application of glue, simplifying and making binding practical and convenient.

The kit according to the invention is suitable for all publishing and graphics software users, including home users and semi-professionals as well as professionals. Such users, who are already proficient with home printers and publishing software, will now have the opportunity of binding their own work in a professional-looking book.

Writers, students, notaries, designers, small and medium sized companies whose professional activities often require them to use the services of a print-shop for single or small series will greatly benefit from the kit according to the invention.

The kit according to the invention is suitable for sale via retail stores or directly over the internet. For instance, many web sites provide short stories and novels online to avoid printing and inventory management costs. Customized kits according to this invention can now be sold online by these web sites so their customers can produce a proper stitch-bound book.

Also, outlets for "print-on-demand" books can use the kits with customized cover designs for binding the individually printed books. This print-on-demand method is both financially and environmentally advantageous because it excludes all risks of overstocking and waste of paper. Using the kit according to the invention, print-on-demand books can now be stitch-bound at reasonable cost.

Further features of the inventive kit for manufacturing a book and the steps for manufacturing a book from the kit, as well as further aspects of the invention, are set out in the claims and in the following description. The claimed further aspects of the invention include a collection of pre-perforated sheets to be used for manufacturing a stitch-bound book, and a method of manufacturing a stitch-bound book in particular using desktop publishing equipment. The stitch-bound book is preferably, but not exclusively, a hard-cover book where the bookblock formed from the printed pre-perforated sheets is mounted in the cover by end papers.

BRIEF DESCRIPTION OF THE DRAWINGS

In the accompanying schematic drawings, given by way of example.

DETAILED DESCRIPTION

Figure 1:
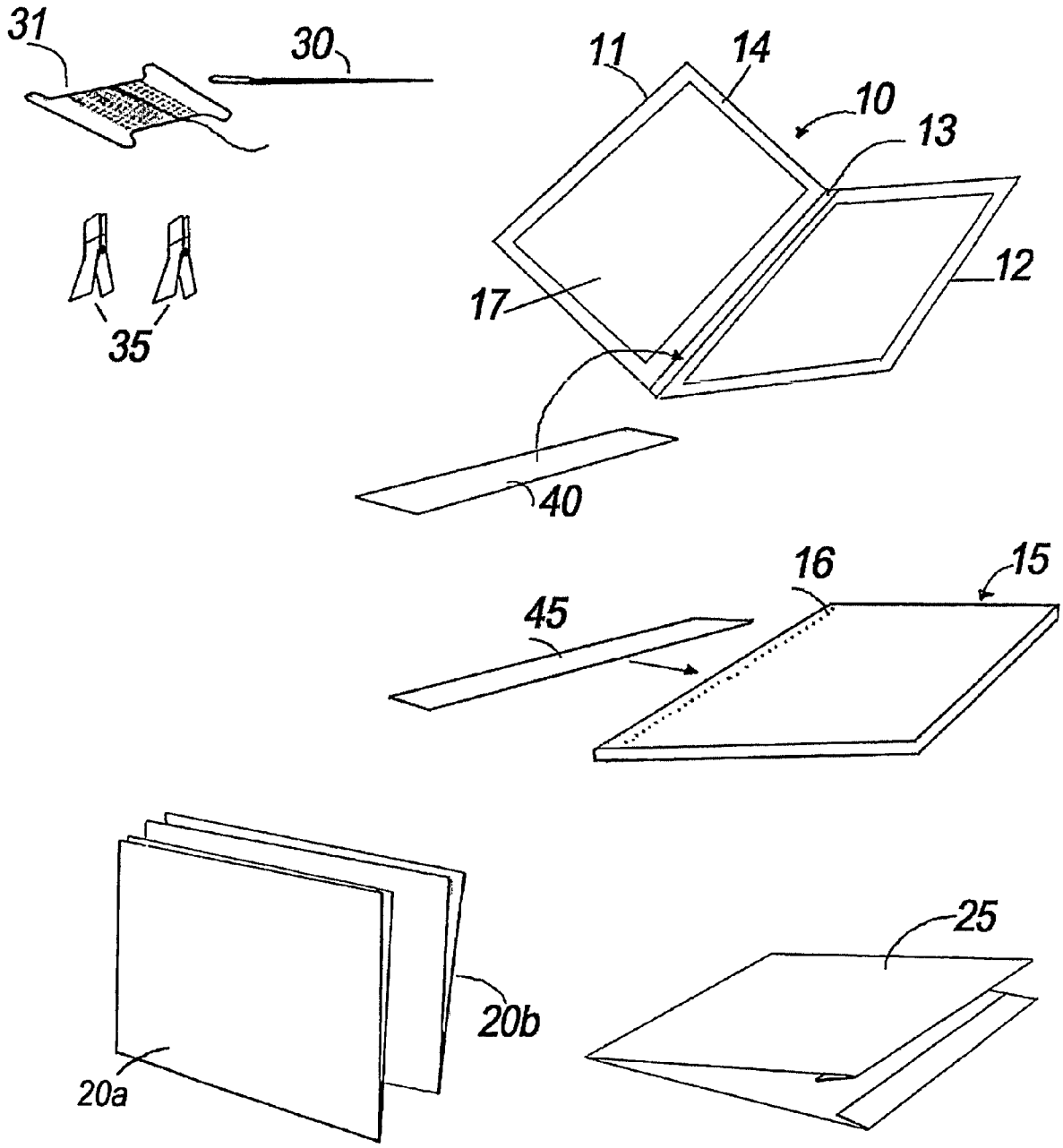
FIG. 1 is an overall view of a book manufacturing kit according to the invention, showing the components separately and not to scale.

FIG. 1 shows the individual components of one embodiment of a book manufacturing kit according to the invention, namely a hard-back cover 10, a pre-perforated collection of loose single sheets 15 of paper, front and back endpapers or "guard pages" 20*a*,20*b*, a cover jacket 25, a needle 30 and thread 31, two clamps 35, a double or single sided adhesive strip 40 for reinforcing the cover spine, and a double-sided adhesive strip 45 for covering the sewn edge of the collection of sheets 15 when it: is formed into a bookblock. These components can be sold/delivered together in one or two boxes containing also printed instructions and/or software.

Software when included may contain assembly instructions and/or a demonstration illustrating the assembly process as well as printing instructions including protocols for standard printers, prompts for placing the paper correctly, etc. Moreover, especially in the case where the kit is designed to produce a book on a specific theme, the software can include standardized texts and/or images that can be merged into the user's input to produce the book's themed content. Typical themes would be for creating the person's own biography, presenting recipes, vacation souvenirs, anniversaries, or other events or subjects.

The illustrated book cover 10 is a hard-back cover made of cardboard, plastics material, leather or imitation leather, or covered therewith. It is usually plain but can also be printed on the outside, e.g. with customized cover designs useful for individuals or businesses who want to produce a series of books with a special cover. The cover 10 can alternatively be a paperback or magazine-type cover. A soft cover will usually employ a paper weighing 180-200 g/m2.

The illustrated cover 10 has a rigid front 11 and back 12 connected by a spine 13. The width and height of the cover's front 11 and back 12 may slightly exceed the dimensions of the collection of sheets 15, and the thickness of spine 13 is chosen according to the intended number of pages of the book. A hard-back cardboard cover 10 like the one shown has, on its inside, folded over edges 14 leaving uncovered central parts 17 that will be covered in the final book by outside sheets of the endpapers 20*a*,20*b* forming so-called board-papers.

The collection of sheets 15 is usually made of A5, 21×21 cm format, or A4 paper, all printable in standard A4 printers. A4 is a practical maximum size adapted to usual desktop printers. The paper is usually good quality "ink jet" paper, typically weighing at least 100 g/m$^2$, preferably at least 120 g/m2. Paper of 135 g/m2 gives excellent results as it permits high quality recto-verso printing on standard printers and is not likely to warp when printed. Ink-jet paper is prefered for kits sold to the public as ink jet printers are in more widespread use by individuals. Sheets of a quality specially intended for laser printing can also be used, in particular for professional users.

The collection of sheets 15 has, along and in the proximity of one edge that corresponds to the book's spine 13, a series of binding perforations 16 for accepting the binding thread 31. This thread 31 is standard white binding thread, and can be supplied in a length of, say, 500 cm. The perforations 16 are of corresponding narrow diameter, about 1-2 mm, able to accept a double thickness of the thread 31.

The perforations 16 are pre-perforated for example by punching or drilling packets of the sheets of paper, before they are separated into collections of a given number of sheets that are included in the kit. The perforations 16 are suitably spaced from the edge of the sheets 5, ay by about 2-4 mm. They can be uniformly distributed along the side of the sheets 15, or can have another distribution, for instance spaced wider apart in the middle. The spacing and distribution of the perforations 16 can be adapted according to the length of the book spine 13, the intended number of pages, the thread specifications and the paper weight. Typical spacing of the perforations 16 is in the range 3-18 mm.

The perforations 16 are so arranged that when the collection of sheets 15 is reassembled after printing the corresponding perforations 16 can be aligned only by placing the sheets in their original orientation. This is conveniently achieved by having a perforation at one end with a different spacing than the others, so it is necessarily out of register if the sheet is inverted.

The double-sided adhesive strip 40 has a length equal to the length of spine 13 and a width of, say 80 mm which is suitable for all spine widths.

The double-sided adhesive strip 45 has a length equal to the spline-forming edge of the sheets 15 and a width of, say, 30 mm which is suitable for the thickness of the collection of sheets 15 to be bound.

The endpapers 20*a*,20*b* serve for assembling the book in the traditional manner. Each endpaper 20*a*,20*b* is a folded-over sheet of double the dimensions of the sheets 15, having an adhesive on one or both of its outer faces protected by a peel-off layer 21 (see FIGS. 5/7). Having an adhesive and a peel-off layer 21 on both outer faces is advantageous from the manufacturing standpoint, as the endpaper 20*a*,20*b* can be made simply by folding an adhesive sheet twice the size of sheets 15. Having two adhesive outer sides also serves to firmly attach the bookblock 18.

The pair of clamps 35 are simple metal or plastic butterfly clamps that serve to secure the collection of pages 15 between the cover 10 in a temporary position for facilitating sewing together of the collection of pages.

The cover jacket 25 is like those fitted on traditional books except that it can be left blank for printing by the user. It is typically made of ink-jet (or laser) quality paper say from 135 $g/m^2$ to 200 $g/m^2$ with a matt or gloss outer surface. Its dimensions exceed twice the dimensions of the book cover 10 so it can be fitted on the finished book by folding it over the edges of the front and back 11/12. The cover jacket 25 will exceed A4 dimensions and is initially folded in a configuration corresponding to a flat dimension that can be accepted by a standard A4 printer. The jacket 25 is thus pre-folded to A4 dimension or less and placed in the printer with the fold entering first.

The size of the sheets 15 corresponds to the size of the cover 10, and the number of sheets 15 included in a kit for individual sale corresponds to the width of the spine 13. Several examples of the dimensions of the various components are tabulated below by way of example. In each case the spine 13 can be provided in several standard dimensions corresponding to a number of pages of paper of given weight in a given range. The kit will usually be supplied with the maximum number of sheets corresponding to the width of spine 13, or more, leaving it to the user to produce a book with less pages. Excess pages can be used for trial printing.

For multiple users, the kit can be supplied with several covers 10 of the same size or of different sizes, and with packages of the perforated sheets 15 whose dimensions correspond to the size(s) of the supplied covers. These packages can be divided into the requisite number of sheets when each book with a given cover 10 is being manufactured.

The width of spine 13 determines the number of pages to be bound, for paper of a given weight. Taking 135 g/m2 paper as an example, a 7 mm spine of a hard-back cover can accomodate say about 15-25 pages; a 10 mm spine about 25-30 pages and a 12 mm spine about 30-50 pages. Soft back covers can accommodate from 5 pages.

Specimen dimensions (in millimetres) for three book formats are given by way of example in the following Tables, namely A5 Portrait in Table I, A5 Upright in Table II and A4 Upright in Table III. In the Tables, "Length" refers to the spine direction. Of course, any sub-A4 format can be accepted.

TABLE I

| BOOK FORMAT: A5 PORTRAIT | Length | Width |
|---|---|---|
| Covers 11, 12 | 155 | 210 |
| Sheets 15 | 148 | 210 |
| Strip 40 | 148 | 80 |
| Strip 45 | 148 | 30 |
| Jacket 25 | 155 | 450 folded |
| Endpapers 20a, 20b | A3 cut lengthwise and folded | |

TABLE II

| BOOK FORMAT: A5 UPRIGHT | Length | Width |
|---|---|---|
| Covers 11, 12 | 215 | 148 |
| Sheets 15 | 210 | 148 |
| Strip 40 | 210 | 80 |
| Strip 45 | 210 | 30 |
| Jacket | 215 | 320 folded |
| Endpapers 20a, 20b | A4, folded | |

TABLE III

| BOOK FORMAT: A4 UPRIGHT | Length | Width |
|---|---|---|
| Covers 11, 12 | 302 | 210 |
| Sheets 15 | 297 | 210 |
| Strip 40 | 297 | 80 |
| Strip 45 | 297 | 30 |
| Jacket | 155 | 450 folded |
| Endpapers 20a, 20b | A3, folded | |

Before the kit is assembled into a stitch-bound book, the pre-perforated sheets 15 are printed by the user to create the desired content of the book consisting of text and images, using a standard A4 desktop printer. Creation of the book content according to a given theme can be assisted by software provided with the kit, as previously mentioned. For printing, the user will usually be familiar with the performance of his printer and only has to set the print command to accept the particular format of the sheets 15 (A5, 21×21 mm, or A4,for example), and orient the sheets according to the printer's specifications. The visible perforations 16 along one edge of the sheets 15 assist the user in selecting the proper feed orientation. The kit can also include instructions to assist the user in printing.

When the endpapers 20*a*,20*b* are provided on both outside faces with adhesive protected by peel-off sheets 21, the front face of the first page of the book and the rear face of the last page of the book are left blank, either by a print command or by removing these sheets from the collection of sheets to be printed and putting them back after printing. The other sheets can all be printed recto or recto-verso. For recto-verso printing, the user will follow the prescribed routine for his printer, e.g. by passing the packet of sheets 15 twice through the printer if the latter does not print recto-verso automatically. Recto-verso printing may also be assisted by the user's desktop publishing software or by software supplied with the kit.

The principal steps in the assembly of the book are illustrated in FIGS. 2 to 7.

Figure 2:
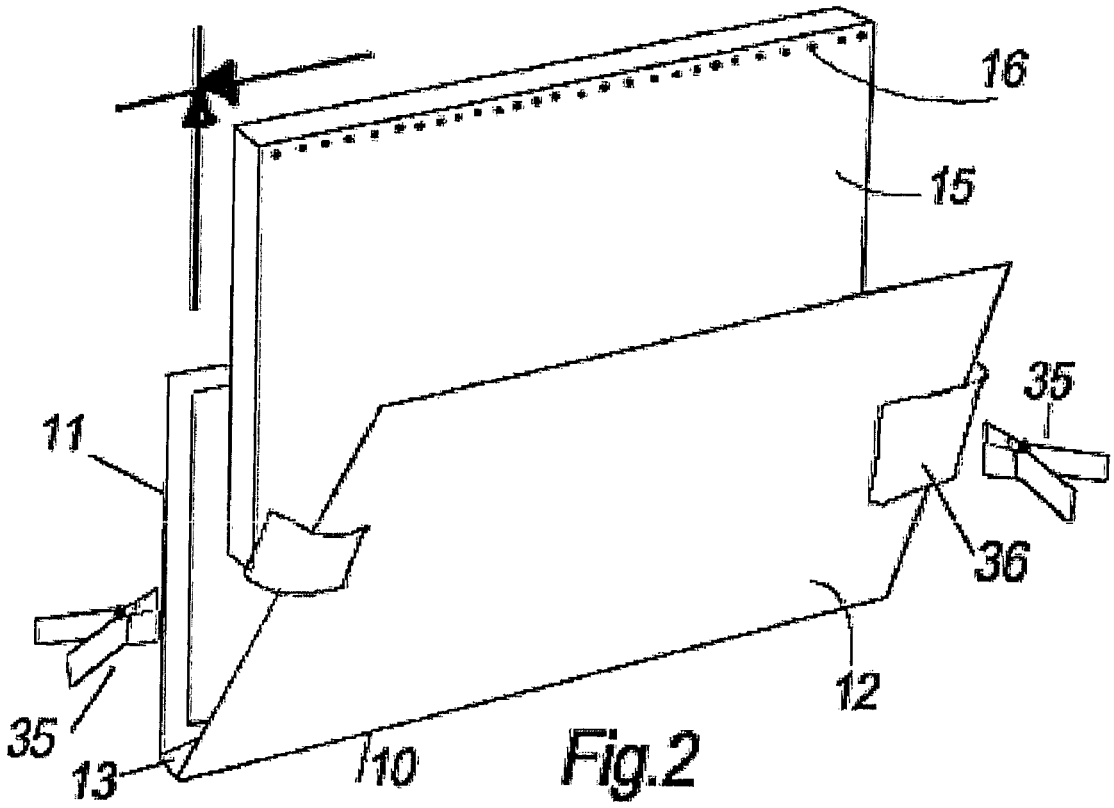
FIGS. 2 to 7 illustrate successive steps in the assembly of a book, after the collection of pre-perforated sheets has been printed.
Figures 3, 3A:
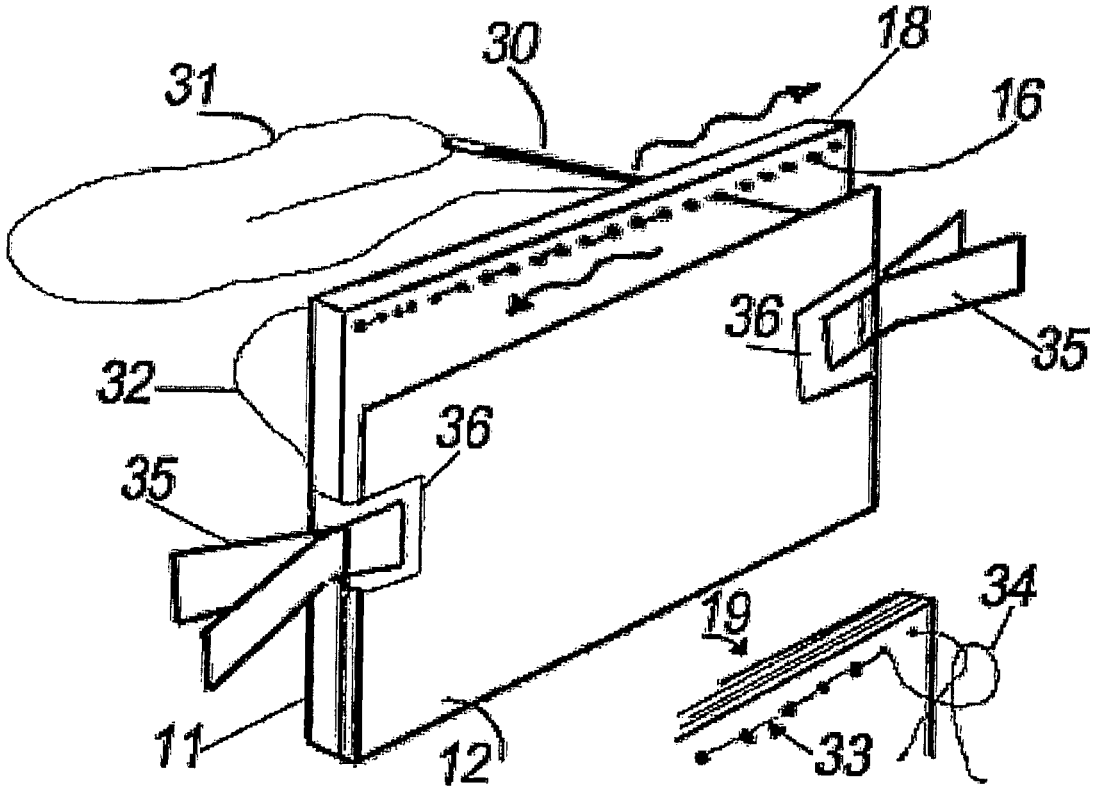

After printing, the pre-perforated sheets 15 are assembled in a block with their perforations 16 aligned. For this, the user collects the sheets into a block and gently taps the edges against a flat surface until a perfect register is obtained, which can be seen by looking through the perforations 16. If a sheet is incorrectly placed, this can be seen as the corresponding perforations in the other sheets will be out of alignment. The user can then re-orient the sheet in question, re-constitute the block and bring the perforations 16 into register. The collection of printed sheets 15 is then placed in the cover 10 as illustrated in FIG. 2 and clamped in place as shown in FIG. 3, using the clamps 35 to hold the cover's front 11 and back 12 together, with interposed pieces of cardboard 36 to protect the cover 10. By applying a ruler against the edges of the sheets 15 just before the block is clamped, the perforations 16 can be perfectly aligned. In the clamped position, the perforated edge of sheets 15 is allowed to protrude from the cover 10, as shown in FIG. 3.

With the sheets 15 firmly clasped in this way, the user then sews them together by passing thread 31 through perforations 16 using the needle 30. The thread 31 is passed through the first perforation 16 and the tail 32 of thread 31 attached to a clamp 35. The needle 30 is then passed through each successive perforation 16 all along the edge of the sheets 15, and then back. The thread 31 passes from one perforation 16 to the next forming a double stitching 33 over the opposite faces of sheets 15, leaving spine 19 free. When this double stitching 33 is finished, the thread 31 is tied with a double knot 34 as indicated in FIG. 3*a*, attached to the side of the spine 19, and the excess thread 31 cut.

Figure 4:
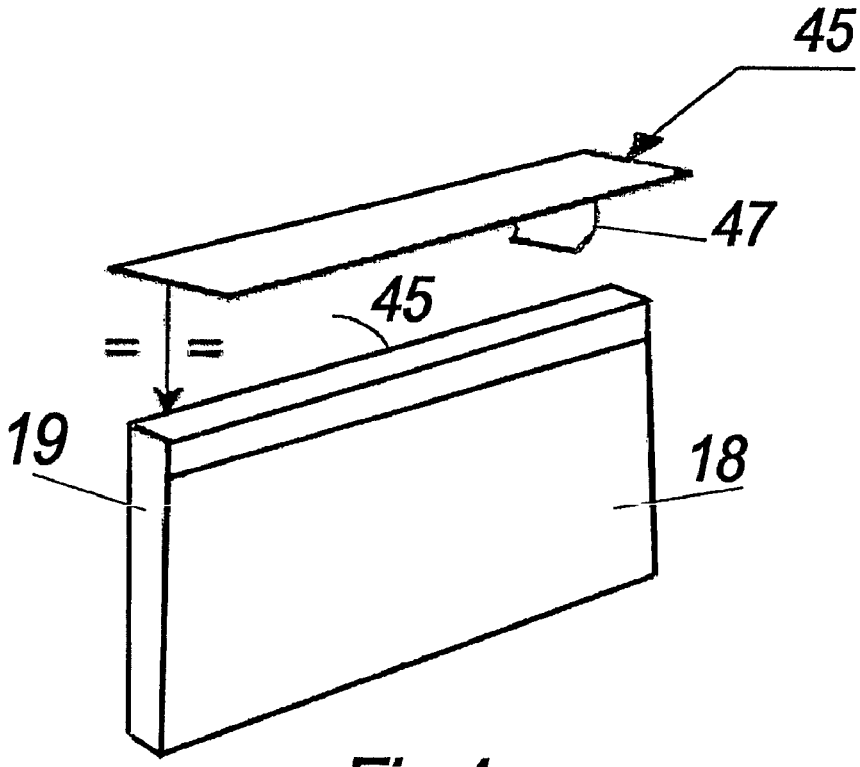

At this stage, the collection of pre-perforated printed sheets 15 constitutes a bookblock 18 whose sewn spine 19 is then covered and reinforced by the strip 45, as shown in FIG. 4. For this, the user removes the protective peel layer 47 from one face of the adhesive strip 45, centres it so it overlaps the spine 19 evenly, places the exposed adhesive face of strip 45 on the spine 19 and presses the adhesive edges of the strip 45 against the opposite faces of the sheets 15 adjacent spine 19.

Figure 5:
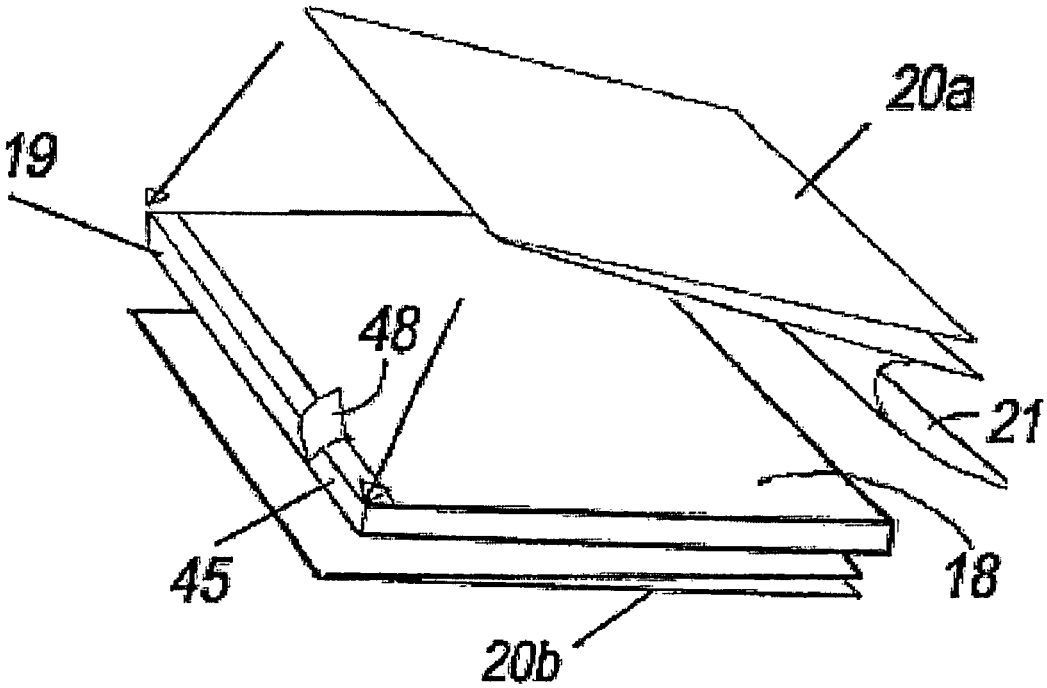
Figure 6:
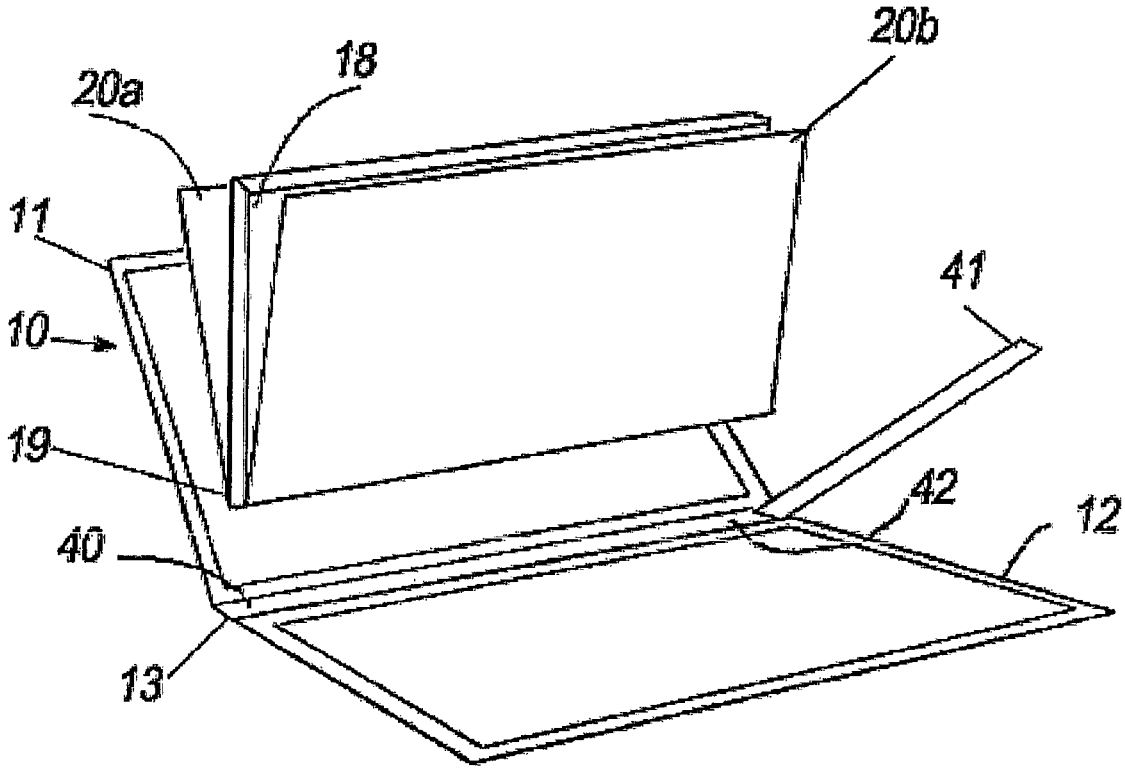

The next step is to attach the endpapers 20*a*,20*b* to the bookblock 18 as shown in FIG. 5. The outer protection 48 of strip 45 is removed, at least on the upper face to be attached first. The protective peel-off layer 21 on the inside of the front endpaper 20*a* is also removed, uncovering its adhesive face. The inside sheet of endpaper 20*a* is then stuck on the non-printed front page of bookblock 18. The same operation is then repeated, to stick the inside sheet of the endpaper 20*b* to the last page of the bookblock 18. As shown in FIG. 6, this forms an assembly of the bookblock 18 and endpapers 20*a*, 20*b* where one half of each endpaper 20*a*,20*b* is stuck to the respective outer face of bookblock 18 and the other half of each endpaper 20*a*,20*b* is ready to be stuck to the respective inside face of cover 10.

Alternatively, if the endpapers 20*a*,20*b* have a protected adhesive only on their outer face, the inside of the endpapers 20*a*,20*b* can be stuck to the bookblock 18 by the adhesive on the outside faces of strip 45. This leaves the front and rear page of book-block 18 uncovered, so that in this case these pages can be printed, if desired.

To attach the assembled bookblock 18 and endpapers 20*a*, 20*b* to the cover 10, one of the strip 40's protective peel-off layers is removed and the adhesive strip 40 is stuck along the spine 13. Then the strip 40's outer peel-off layer 41 is removed, leaving an exposed adhesive layer 42 on spine 13. The bookblock's spine 19 is then aligned with the cover's spine 13, making sure it is centred as accurately as possible and, of course, in the proper orientation. The bookblock spine 19 covered with the adhesive strip 45 is then applied with slight pressure against the spine 13's adhesive layer 42, until they are well fixed together.

Figure 7:
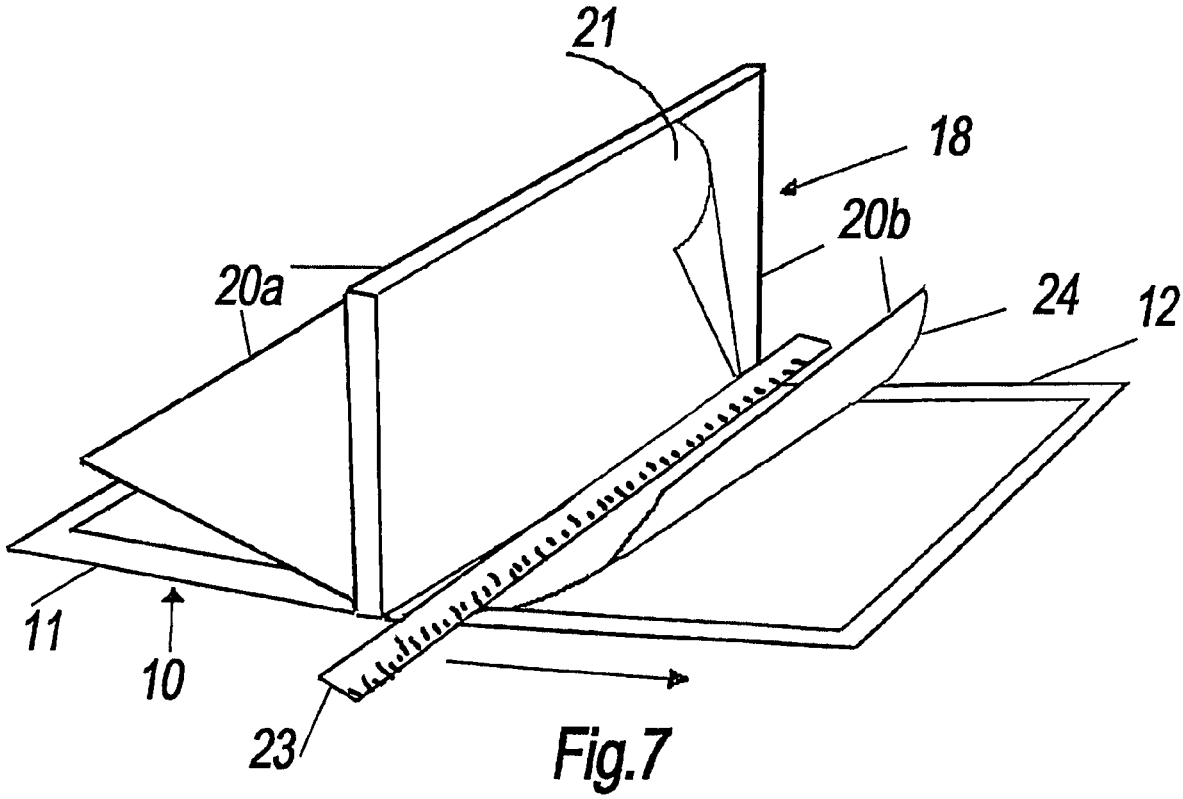

Then, holding the bookblock 18 upright with the cover 10 lying flat as shown in FIG. 7, the protective peel-off layer 21 is removed from the outside of one of the endpapers 20*a*,20*b*, as indicated for illustrative purposes on the upstanding bookblock 18. Holding the endpapers 20*a*,20*b* in upright position, a ruler 23 is inserted between the two sheets of one of the endpapers, as shown for endpaper 20*b*. The outer half 24 of the endpaper 20*b* is then allowed to drop gently onto the inside of the cover back 12, at the same time running the ruler 23 over the back 12 as indicated by the arrow. This sticks the endpaper's outer half 24 on the cover back 12 as a so-called board paper, without any creases. The same operation is then repeated with the remaining endpaper 20*a* to stick its outer half on the front 11.

The fully assembled book is then placed under a flat weight, for instance a pile of books, leaving the spine 19 on the exterior, for a period sufficient to consolidate the binding, say 24 hours.

The finished book has the advantageous structure of a traditional stitch-bound book characterized by the stitch-bound bookblock 18 mounted by the endpapers 20*a*,20*b*, but thanks to the invention individual books or small series of books can now be manufactured at a fraction of the cost making use of available desktop publishing equipment.

The described assembly procedure can be easily mastered by adults and children with no prior book binding experience. It is even possible with a little practice to assemble a book in a comparable time to that taken for binding a book using an office hot-melt binder.

The invention unites recent desktop publishing technology with traditional bookbinding techniques to create a new and much-needed possibility of presentation for desktop publishers.

Many variations are possible. In general a stitch-bound book can be manufactured according to the invention using a bookblock formed from the collection of printed pre-perforated sheets and binding the bookblock in a cover. Preferably, the bookblock is mounted in a hardback cover using endpapers as described, but it could be mounted otherwise in a softback or in a magazine-type cover.

The invention claimed is:

1. A kit for manufacturing a stitch-bound printed book, comprising:

a book cover (10) composed of a front (11) and a back (12) attached by a spine (13) for accepting a bookblock (18) formed from a collection of bound pages of corresponding size;

a corresponding collection of pre-perforated loose unfolded single sheets (15) for making up a bookblock (18) that fits the book cover (10), the pre-perforated loose sheets (15) having printable areas and their size corresponding to a given printing format acceptable by available personal printers, the collection of sheets (15) having along and in the proximity of and spaced apart from one edge of each sheet that corresponds to the book's spine a series of binding perforations (16) for accepting a binding thread (31), the pre-perforated loose unfolded sheets (15) being already perforated prior to printing the sheets in said printable areas whereby the pre-perforated sheets are printable in said printable areas on one or both sides in a printer to constitute printed pages of the book, the printed pages being bindable to form said bookblock (18) by reconstituting the unfolded sheets as a collection with their perforations (16) aligned and by sewing thread (31) through the perforations (16);

two folded-over sheets forming front and back endpapers (20*a*,20*b*) whose folded-over dimensions correspond to those of the single sheets, the outer face of one part of the two folded-over endpapers being attachable, one to the front and the other one to the back of the bookblock (18) formed by sewing together the collection of loose printed unfolded sheets (15), with the fold of the folded-over endpapers adjacent to the sewn edge of the bookblock, and the outer face of the other part of the two folded-over endpapers being attachable, one to the inside front face (11) and the other to the inside back face (12) of the book cover (10), for securing the bookblock (18) formed by sewing together the collection of loose printed unfolded sheets (15), to form the stitch-bound printed book; and adhesive layers (21,47,48) for securing the bookblock (18) to the front and back endpapers (20*a*,20*b*) and for securing the front and back endpapers (20*a*,20*b*) to the cover (10), these adhesive layers being protected by peel-off layers.

2. The book manufacturing kit of claim 1, wherein the book cover (10) is a hard-back cover, made of cardboard, plastics material, leather or imitation leather, or covered therewith.

3. The book manufacturing kit of claim 1, wherein the binding perforations (16) are so arranged that when the collection of sheets (15) is reassembled the binding perforations (16) can be aligned only by placing the sheets (15) in their original orientation.

4. The book manufacturing kit of claim 1, wherein each endpaper (20*a*,20*b*) is a folded-over sheet having an adhesive protected by a peel-off layer (21) on one or both of its outer faces.

5. The book manufacturing kit of claim 1, comprising a double-sided adhesive sheet (45) protected by peel-off layers (47,48), one adhesive side for securing the bookblock (18) over its edge corresponding to the cover spine (13) and over the sewn perforations (16,33), and the other adhesive side for securing the bookblock (18) to the endpapers (20*a*,20*b*).

6. The book manufacturing kit of claim 5, wherein each endpaper (20*a*,20*b*) is a folded over sheet having an adhesive protected by a peel-off layer (21) on one of its outer faces, the other of the outer faces of each endpaper (20*a*,20*b*) being securable to the assembled bookblock (18) by said adhesive side of the double-sided adhesive sheet (45) when the latter is secured over the edge of the bookblock (18).

7. The book manufacturing kit of claim 1, further comprising a double or single-sided adhesive sheet (40) protected by at least one peel-off layer (41), for adhering to and reinforcing the cover spine (13).

8. The book manufacturing kit of claim 1, further comprising a pair of clamps (35) for securing the collection of pages (15) between the covers (11,12) in a temporary position for facilitating sewing together of the collection of pages (15).

9. The book manufacturing kit of claim 1, further comprising software containing at least one of: assembly instructions and/or a demonstration of assembly; printing instructions; and texts and/or images, in particular corresponding to a theme for the book to be manufactured.

10. The book manufacturing kit of claim 1, wherein the collection of sheets are A5, 21×21 cm, or A4 format, printable in standard A4 printers.

11. The book manufacturing kit of claim 1, further comprising a cover jacket (25), the cover jacket having dimensions exceeding twice the dimensions of the book cover (10) SO it can be fitted on the finished book by folding it over the edges of the cover (10), the cover jacket (25) being initially folded in a configuration corresponding to a flat dimension that can be accepted by a standard printer, in particular an A4 printer.

12. A method of manufacturing a stitch-bound book from a kit as claimed in claim 1, comprising:

selecting a collection of the pre-perforated loose unfolded single sheets (15) for making up a bookblock (18) that fits a book cover (10), the loose pre-perforated sheets (15) having printable areas and their size corresponding to a given printing format acceptable by available personal printers, the pre-perforated loose unfolded sheets (15) being already perforated prior to printing the sheets in said printable areas whereby the pre-perforated sheets are printable in said printable areas on one or both sides in a printer to constitute printed pages of the book, the collection of sheets (15) having along and in the proximity of and spaced from one edge of each sheet that corresponds to a book's spine a series of binding perforations (16) for accepting a binding thread (31);

printing the printable areas of the pre-perforated loose sheets (15) on one or both sides in a printer to constitute printed pages of a book;

reconstituting the printed unfolded sheets as a collection with their perforations (16) aligned;

sewing thread (31) through the aligned perforations (16) to form a stitch-bound bookblock (18) mountable in a book cover (10); and attaching the two folded-over endpapers (20*a*,2*b*), whose folded over dimensions correspond to those of the single sheets, to the bookblock (18) and to the book cover (10), by:

attaching one part of the two folded-over endpapers, one to the front and the other to the back of the bookblock (18), with the fold of the folded-over endpapers adjacent to the sewn edge of the bookblock; and attaching the other part (11) of the two folded-over endpapers one to the inside front face (11) and the other to the inside back face (12) of the book cover (10), to form the stitch-bound printed book.

13. The method of claim 12, wherein:

the bookblock (18) is assembled by applying a double-sided adhesive strip (45) over the edge of the bookblock (19) corresponding to the cover spine and over the sewn perforations (16,33); and the front and back endpapers (20*a*,20*b*) are attached to the bookblock (18) by said double-sided adhesive strip (45) on the bookblock (18).

14. The method of claim 13, wherein: the folded-over front and back endpapers (20*a*,20*b*) united with the bookblock (18) are attached to the inside front and back faces (11,12) of the book cover (10) by removing a protective peel-off layer (21) from the outside faces of the endpapers (20*a*,20*b*) to uncover adhesive faces thereof, and applying these adhesive faces against the inside front and back faces (11,12) of the book cover (10).

* * * * *